United States Patent [19]

Gordon et al.

[11] 4,314,424

[45] Feb. 9, 1982

[54] THERMAL WINDOW CONSTRUCTION

[76] Inventors: Stanley J. Gordon; Henry R. Frambach, both of 175 Sea Cliff Ave., Glen Cove, N.Y. 11542

[21] Appl. No.: 106,673

[22] Filed: Dec. 26, 1979

[51] Int. Cl.[3] ..... E05D 7/00

[52] U.S. Cl. ..... 49/400; 49/DIG. 1; 49/484; 49/501; 52/208; 52/403

[58] Field of Search ..... 49/501, 504, 381, 400, 49/401, 402, DIG. 1; 52/208, 403, 235, 483, 476, 202, 203

[56] References Cited

U.S. PATENT DOCUMENTS

| | | | |
|---|---|---|---|
| 3,478,476 | 11/1969 | Kemp | 52/208 |
| 3,861,085 | 1/1975 | Jacob | 49/400 X |
| 4,084,361 | 4/1978 | Aspaas | 49/DIG. 1 |
| 4,132,035 | 1/1979 | Frambach | 49/381 X |

*Primary Examiner*—Kenneth Downey

[57] ABSTRACT

This invention relates to a thermal window construction which comprises a fixed frame member and a movable frame or operating sash member. The window is characterized in that the operating sash member includes an outwardly facing glazing surface to which a pane sub-assembly comprising two or more glass lites are connected, the bond between the pane sub-assembly and operating sash being provided by a bead or quantity of silicone interposed between an inwardly directed surface of the sub-assembly and the glazing surface through a laterally open channel, whereby complete filling of the said space may be assured. The overlapping areas of glass and metal bonded by the silicone rubber material are coordinated with the glass expanse and weight in such manner that the stress applied to the bonded areas will not exceed about 20 p.s.i. The fixed frame member includes a flange member which outwardly laps the outermost face of the sub-assembly, a deformable gasket or the like being disposed between these parts, to define a weather-tight seal with said outer face. The assembly includes, in addition, a resilient seal member extending between a thermally isolated portion of the outer frame assembly and engaging and outwardly lapping portions of the movable frame or sash assembly and also an insulating barrier member carried by the movable frame whereby, in the closed position, all portions of the movable frame are isolated from the exterior.

20 Claims, 5 Drawing Figures

THERMAL WINDOW CONSTRUCTION

BACKGROUND OF THE INVENTION

1. Field of the Invention

The present invention is in the field of window devices and is directed more particularly to an improved window assembly including a fixed frame member within which an operating sash is pivotally mounted, the device being characterized by a high degree of thermal isolation, a highly pleasing aesthetic appearance, and the ability readily to remove and replace broken glass without the necessity for disassembling the frame.

2. The Prior Art

Modern building constructions, and particularly high rise building constructions, employ in a large majority of instances exterior portions comprised predominantly of glass. Typically, the building may include a mixture of fixed glazing and operating sashes.

In accordance with present architectural thinking, it is considered highly desirable that the sight line or thickness of metal surrounding the glass members be minimized for aesthetic and economic reasons and to minimize heat losses through the frame. Additionally, the window construction incorporating the operating sash in the closed position must provide a high degree of thermal isolation to avoid heat loss in the winter or admission of heat to air-conditioned premises in the summer. It is, moreover, highly desirable, in the event of glass breakage, that the glass lites be replaceable, preferaby without disassembly of the operating sash structure.

It is a further obvious desideratum that the window construction be as inexpensive as is feasible consistent with safety and aesthetics.

Numerous window constructions attempting to realize one or more of the above mentioned desirable factors have been created, which window structures, in varying degrees, achieve the desired ends.

Certain of the window structures, such as illustrated by way of example, in U.S. Pat. No. 3289,377—Hetman—provide relatively effective thermal breaks and, consequently, low heat loss. Other of the windows, as exemplified by U.S. Pat. Nos. 4,132,035, Frambach and others attempt to provide relatively narrow sight lines and, in addition, relatively efficient thermal isolation.

Various sealing materials have been employed as a means for isolating the glazing from the glazing-adjacent surfaces. Additionally, numerous glazing systems have been suggested, which systems employ, inter alia, Neoprene, vinyl and/or silicone materials. By way of example, reference may be made to a brochure published by General Electric Corporation and entitled "Silicone Construction Sealants in Structural Glazing Systems" (Silicone sealant design guide #4.)

In all of the window structures heretofore known wherein an operating sash is carried within a metal or like frame or perimeter member mounted to the structural components of the building, no single unit has been created which incorporates all of the aforesaid desiderata.

SUMMARY OF THE INVENTION

The present invention may be summarized as directed to an improved thermal window construction characterized in that, in addition to providing a high degree of thermal isolation of the operating sash, metal and glass components, it is relatively inexpensive to construct, durable, attractive, readily reglazed and provides a narrow sight line, minimizing exposure of metallic components at the exterior of the building. It is further characterized by a monolithic unity of metal, glass and silicone bond mutually supportive so as to provide an exceptionally strong construction.

More particularly, the invention is characterized in the provision of an operating or movable sash pivotally connected to a stationary outer frame member, which outer frame member incorporates inner and outer frame components separated by a conventional thermal break. The movable frame section, which is pivotally supported to the inner of the two components of the fixed frame, includes an outwardly directed and preferably generally planar glazing surface.

A pane sub-assembly comprising one or more glass lites is structurally secured to the glazing surface of the operating sash by a relatively thick, i.e. $\frac{1}{4}''$ to $\frac{3}{8}''$, continuous bead of silicone material injected into an outwardly facing perimetal recess, the silicone being introduced into the recess in a direction parallel to the glazing surface and the lite or lites of glass. Uniquely, the operating sash includes no portion or portions which overlap the side edges of the innermost pane or panes of glass, as is the invariable practice with operating sash structures heretofore known, whereby, in accordance with the present construction, the desired parallel injection of silicone may be effected.

In contrast to operating sash constructions heretofore known, the parallel injection of silicone rubber into the recess between the glass and frame components results in a predictably strong bond being formed between the noted surfaces whereby a monolithic construction is achieved wherein the stiffness of the glass augments the stiffness of the frame. Accordingly, it is feasible to use lighter frame constructions than is the case in conventional constructions wherein the frame covers portions of the front, side and rear surfaces of the pane assembly and a predictably strong bond between the innermost face of the inner glass lite and the outwardly directed and opposite face of the frame cannot be formed due to the high viscosity and poor flow characteristics of the silicone rubber compound. In such conventional devices, the glass is free to shift relative to the supporting frame and the dry or wet compound acts merely as a sealant.

The window construction in accordance with the present invention makes use of the great structural strength of glass in the plane of the glass. The rigidifying effect of the glass on the frame enables the provision of large ventilators without the use of thick, expensive, unsightly and thermally inefficient reinforcing frames. Also, due to the rigidifying influence of the glass on the frame, there is virtually no tendency for the frame to sag to a parallelogram configuration under the weight of the glass, as is the case with conventional operating sashes.

The invention is further characterized by the outer frame member including a flange outwardly lapping the outer face of the pane sub-assembly and defining, through a weather-stripping member, a seal with the front face of the pane, whereby the pane member is pressed inwardly toward the operating sash in the closed position of the window.

The device is further characterized by the provision of a second weather-stripping member spanning the space between the outer thermally broken portion of the frame and the operating sash and preferably, in addition, in contact with a portion of the pane sub-assembly or an insulating shield member surrounding the pane sub-assembly whereby all portions of the operating sash are thermally isolated from a surrounding chamber defined between the outer components of the fixed frame and the pane sub-assembly.

With the foregoing in mind, it is an object of the invention to provide an improved thermal window assembly of the type described.

A further object of the invention is the provision of a thermal window assembly including a fixed frame and an operating sash carrying one or more glass lites wherein the glass lites are structurally secured to the operating sash essentially solely by a bead or quantity of silicone lying between parallel surfaces of the inner pane member and a glazing component or surface of the operating sash, no portion of the sash overlapping the outwardly facing channel or recess between the pane and the glazing surface, whereby a complete and continuous filling of the said channel or recess may be predictably effected. By avoiding any overlap of the operating sash beyond the side marginal edges of the pane sub-assembly, reglazing of the operating sash may be readily effected without disassembly of the operating sash frame since the removal of components of a damaged pane sub-assembly may be effected by simply extending a cutting tool through the bonding silicone material in a direction parallel to the glass.

Still a further object of the invention is the provision of a construction of the type described wherein there is defined in the closed position of the window a continuous, perimetal chamber extending completely about the pane sub-assembly, which chamber is sealed except for weep holes required for drainage and pressure equalization, all portions of the operating sash member being isolated from contact with the noted perimetal chamber, whereby no heat bridges between closely adjacent metal components are present for the transfer of heat between the outer frame and the operating sash.

To attain these objects and such further objects as may appear herein or be hereinafter pointed out, reference is made to the accompanying drawings, forming a part hereof, in which.

Figure 1:
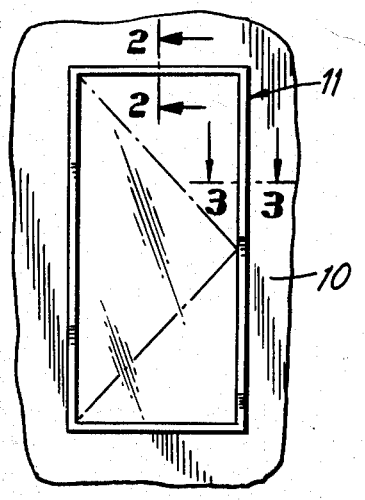
FIG. 1 is an elevational view of a window construction in accordance with the invention.

Referring now to the drawings, there is shown in FIG. 1 an exterior surface of a building 10 with an opening in which there is provided a window structure 11 as more specifically described hereinafter.

Figure 2:
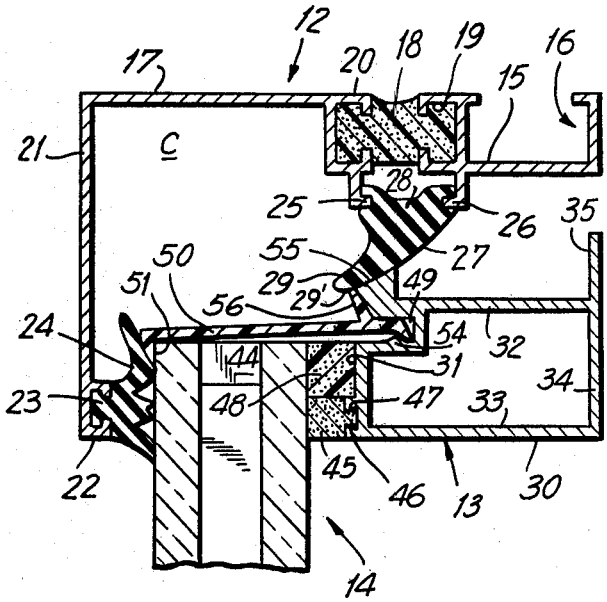
FIG. 2 is a magnified vertical section through the head of the window assembly, taken on the lines 2—2 of FIG. 1.
Figure 3:
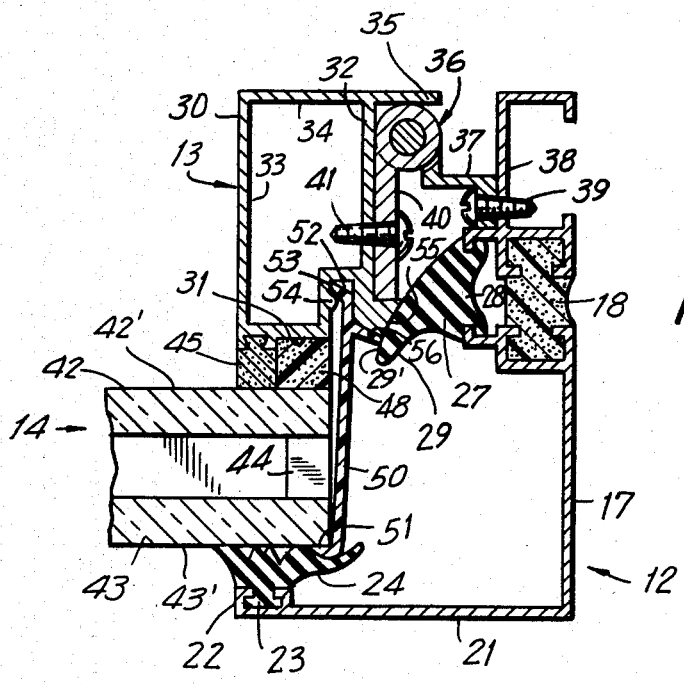
FIG. 3 is a horizontal section taken on the lines 3—3 of FIG. 1.

Referring particularly to FIGS. 2 and 3, the window construction includes an outer frame assembly 12, a movable sash assembly 13 and a pane sub-assembly 14 secured to the movable sash assembly.

The outer frame assembly 12 is comprised of an inner frame member 15 which is secured to appropriate structural components fixed to the building 10. Optionally, the frame component 15 may include a box formation or channel 16 within which support bars (not shown) extending from the building structure may be received to provide structural connection between the building and the frame component 15.

The outer frame 12 includes an outer frame member or component 17 connected to the inner frame component 15 by a relatively rigid thermal isolating filler member 18, such as vinyl or like polymeric material. The filler member 18 may be received within opposed box formations 19, 20 formed in the metallic extrusions comprising the inner and outer frame members 15 and 17, respectively, as is conventional.

The outer frame member 17 includes an inwardly directed flange 21 at its exterior surface. The flange, at its innermost or distal end 22, includes a continuous weather-strip retainer channel 23, within which channel is lodged a resilient, readily deflectible weather-stripping component 24.

The outer frame components 15 and 17, at a position opposite the polymeric material 18, include opposed finger portions 25, 26 providing anchorage for a continuous perimetal inner seal member 27 having fused corners. The seal member 27 which like seal 24, may be comprised of an elastic or readily deformed material, includes a root portion 28 captured between the fingers 25, 26 and an elongate flexible lip portion 29 for defining a seal with portions of the operating sash assembly.

The operating sash assembly 13 includes a metallic frame component 30 which, like the components 15 and 17, may preferably be comprised of aluminum or aluminum alloy. The extrusion 30 includes an outwardly facing glazing surface 31, parallel side faces 32, 33 and a rear or innermost surface 34. The innermost surface 34 may include an inner flange extension 35.

Pivotal connection between the operating sash 13 and the fixed frame assembly 12 may be accomplished in any of a multiplicity of different manners by a hinge or pivot mechanism or mechanisms spanning and connected between the inner portion 15 of the outer frame and the operating sash extrusion 13. Illustratively, and as seen in FIG. 3, a hinge member 36 may include a first leaf 37 screwed or bolted to a web 38 of the outer frame portion 15 as by machine screws 39. A second leaf 40 of the hinge member 36 is secured as by machine screws 41 to the side face 32 of the operating sash assembly.

The glazing or pane sub-assembly 14 is optionally but preferably comprised of inner and outer glass lites 42 and 43, respectively, the lites being secured together adjacent their marginal edges by a continuous glazing bond 44. The glazing sub-assembly 14 is secured to the operating sash 13 prior to assembly of the operating sash to the fixed frame member by a glazing procedure which includes the step of first mounting a Neoprene seal member 45 to the glazing surface 31, as by dovetailed interfit of a rib portion 46 of the Neoprene seal within an appropriately configured dove-tailed recess 47 on the surface 31. As disclosed, the Neoprene member 45 is inset from the edge or marginal end portions of the glass lites 42, 43 by a distance normally in the area of from about $\frac{1}{4}''$ to $\frac{1}{2}''$, $\frac{3}{8}''$ being an average preferred distance. With the glass lites thus emplaced and with the operating sash 13 disposed on a horizontal surface so that the glazing surface 31 is arrayed in a horizontal plane, the pane sub-assembly may be seated and supported on the seal member 45.

It will thus be observed that there is defined between the innermost face 42' of the glass lite 42, the seal 45, and the remaining portions of the glazing surface 31, an outwardly open continuous perimetal recess or channel.

Into this recess there is extruded a bead 48 of silicone rubber structural sealant compound, known per se (said compound, for convenience, being herein referred to usually merely as silicone.) By way of example, and without limitation, a suitable silicone rubber composition is identified in U.S. Government Federal Specification No. TT-S-001543A (Com-NBS) dated June 9, 1971 and entitled Interim Federal Specification Sealing Compound: Silicone Rubber Base (for caulking, sealing, and glazing in buildings and other structures.

The described material, which is of the "no sag" type, renders possible economies in production in that a multiplicity of frame assemblies may be stacked one atop the other on a horizontal surface, and thereafter the silicone rubber material injected into the recesses of the stacked units.

It is important to note that the silicone bead 48 may be injected in a direction parallel to the plane of the glass sheet 42 whereby there is assurance that the entirety of the perimetal channel defined hereinabove may be completely filled without fear of interruptions. It should be recognized that the silicone material is a highly viscous mass, and therefore relatively limited flow may be achieved under gravitational influence. Accordingly if, as has been universally the case heretofore, a flange or flanges were present on the operating sash, which flanges extended into the path of the channel so as to block a direct injection of the silicone material in a direction parallel to the plane of the glazing, there would be no assurance that the opposed surfaces of the glazing 31 and the inner surface 42' of the lite 42 would be fully and completely contacted by the injected bead. In the absence of such full and complete contact, while the silicone might function as an effective seal, the structural bond defined would be insufficient securely to connect the glazing sub-assembly to the operating sash. Where, however, the perimetal channel or recess is left open for lateral injection, the bond between the glass and the operating sash afforded by the silicone is sufficiently strong positively to preclude separation of the noted components after curing of the silicone. Also, since a cure period of many days is required to achieve a dependable bond, the ability to apply the silicone to stacked window units materially reduces handling the maximizes the efficient use of space.

The operating sash member 13 may include a shield retainer channel 49 within which may be mounted a polymeric side edge shield member 50 surrounding the margins of the glass lites 42, 43. The shield 50 may include an outer lip 51 which outwardly overlaps the outer surface 43' of the outer pane 43. The shield 50 includes an inner anchor portion 52 having an anchor tooth 53 which enters behind rib 54 of the operating sash, whereby the shield 50 is retained within the channel.

The operating sash 13 may include a laterally directed seal surface 55 which is arcuate, providing a curvature matching the curvature of the sealing surface 29' and lip 29 of the inner seal 28. The shield member 50 may include an inwardly directed fin 56 which forms a continuation of the arcuate surface 55.

From the foregoing description it will be observed that in the shut condition of the window, as depicted in FIGS. 2 and 3, there is defined a sealed outer perimetal chamber C (the exception to such sealing being weep holes (not shown) formed in the sill section for drainage and pressure equalization purposes).

The perimetal chamber C is sealed in its inner boundary by contact of the sealing surface 29' with the fin 56 of the shield 50 and the surface 55 of the operating sash. An outer seal is defined between the seal member 24 which engages portions of the surface 43' of lite 43, the seal 24, in addition, engaging the lip 51 of the said shield 50.

As will be apparent from an inspection of FIGS. 2 and 3, by virtue of the engagement of the portion 29' of lip 29 with the fin 56, all portions of the operating sash member are isolated from the exterior pressure equalization chamber, which necessarily must contain air at a temperature close to outside ambient temperature.

Further, improved thermal isolating effects are achieved since no portion of the operating sash assembly or hardware lies alongside or extends forwardly of the glazing materials, as is invariably the case with conventional window constructions. In other words, in all operating window constructions heretofore known, the metallic frame components carrying the glazing lite or lites include portions lying forwardly of, or at least alongside, the side marginal edges of the glass components. Under such circumstances, elements of the pane carrying frame and hardware are inevitably exposed to the exterior environment, or at least are intimately juxtaposed to portions of the outer frame, whereby a heat bridge between the adjacent components is formed, with consequent thermal loss. By isolating all portions of the operating sash and hardware interiorly of the innermost pane in the present device, such substantial heat losses are eliminated, as is the necessity for providing a thermal break in the operating sash.

Figure 4:
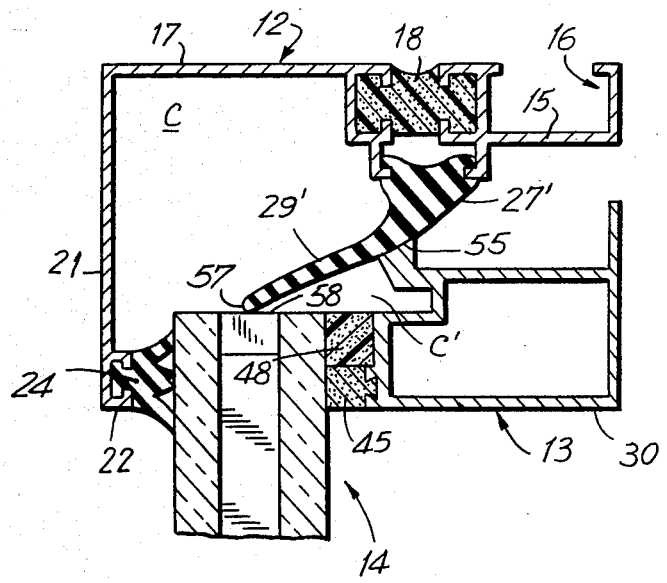
FIGS. 4 and 5 are horizontal sectional views similar to the view of FIG. 3 through two additional embodiments of the invention.

Referring now to the embodiment disclosed in FIG. 4, wherein like parts have been given like reference numerals, the configuration therein disclosed embodies a somewhat changed conformation.

In accordance with the said embodiment, the seal member 27' includes an elongate lip portion 29'. In this embodiment a first sealing contact is effected between an intermediate part of the lip portion 29' and the arcuate surface 55 of the operating sash, a second sealing contact being effected between the free end portion 57 and an edge portion 58 of the pane sub-assembly 14. Contact between the end portion 57 and pane sub-assembly 14 may occur with the edge of the inner pane 42, as shown in FIG. 4, or at any point along the side edges of the sub-assembly 14 outboard of the outerwardly facing surface of the inner pane or lite.

Optionally, it may be desirable, in order to shield the raw edges of the glass, to wrap a convolution of tape about the sub-assembly 14 to cover the entirety of the said edges thereof.

It will be noted that in the embodiment of FIG. 4 there is defined a first perimetal chamber C externally of the seal member 27' and a second perimetal chamber C', the outermost face of which second chamber is provided by the seal, the remainder of such chamber being bounded by portions of the operating frame and by the silicone composition 48.

Figure 5:
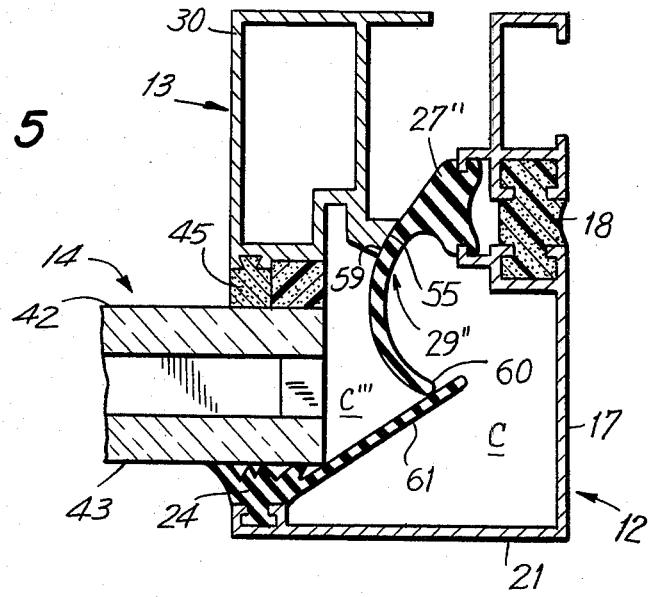

In the embodiment of FIG. 5, the seal member 27'' includes a readily deflectible and resilient sealing portion in the form of an elongated tongue 29'', one portion 59 of which engages the arcuate surface 55 of the operating sash and the distal portion 60 of which engages a web member 61 extending inwardly into the perimetal chamber C from the front or outer seal member 24. In this embodiment, the space forwardly of the operating sash and between said sash and the outer frame portions 17 and 21 is divided into two chambers C and C'''.

The embodiment disclosed in FIG. 5 has the further advantage that the entirety of the edge portion of the glazing sub-assembly 14 is protected from exposure to the environment in the closed condition of the window assembly.

As may be perceived from the foregoing description, there is provided in accordance with the invention a thermal window assembly of simple design which is highly effective in resisting heat transfer from the interior to the exterior of a building structure. The structure permits of rapid and simplified reglazing of the window frames without the necessity for disassembling the frames, and dispenses with the necessity for providing an operating sash which embodies a thermal break since all portions of the operating sash are isolated from exposure to the exterior environment.

The device is further characterized in its use of the glazing lite or lites as a structural element or component of the window assembly, the lite or lites being bonded by silicone to an outwardly facing portion of the operating sash, the operating sash being relatively less rigid than required with conventional sash structures.

Since the frame need not be rigid, narrower frame components may be suitably employed, permitting narrow, aesthetically pleasing sight lines.

A further extremely important advantage of the described construction lies in the fact that all metal portions of the operating sash are shielded from any contact not only with the exterior environment but also with the chamber surrounding the sash, the outermost wall portion of which is formed by the fixed frame. The noted perimetal chamber will normally be at a temperature corresponding to the ambient external temperature. Since the inner of the two seals defined between the fixed outer frame and the operating sash assembly is formed at a position outward of the metal components of the inner or operating frame, complete thermal isolation of the inner frame is achieved without formation of a thermal break in the operating frame. Further, since all portions of the operating frame are located inwardly of the glass, no thermal bridge to the inner frame is formed.

In accordance with the preferred embodiments of the invention, there are provided two seal areas, namely an outer seal area at the external face of the outermost glass lite and an internal seal in the area between the operating sash and the frame. Preferably, a third seal is also defined between the outer frame structure externally of the thermal break and an insulating portion forwardly of the operating sash frame whereby even higher thermal isolation is achieved.

In view of the fact that neither the front faces nor the sides of the glass lites are overlapped by any portion of the operating sash, extremely narrow sight lines are made possible and heat bridges between closely adjacent portions of the operating sash and fixed frame member are avoided. By avoiding a structure in which any portion of the operating sash overlaps the side edges of the pane subassembly, there is provided a laterally open channel or recess which may readily be filled by the highly viscous silicone rubber material flowed into the gap, recess or channel in a direction parallel to the surface of the innermost pane and the opposed surface of the operating sash whereby a continuous, unbroken and secure bead of silicone can predictably be formed.

It will be evident from the instant disclosure that those skilled in the art and familiarized herewith may arrive at variations and modifications in the structural aspects of the invention without departing from the spirit thereof.

For instance, while the weather-stripping component 24 is disclosed to be carried by the flange 21 of the outer frame, it is feasible for the member 24 to be secured to the operating sash and extend outwardly alongside the side margins of the lites and overlap the front face of the same to be engaged by inwardly directed portions of the flange 21 in the closed position of the window. Similarly, the seal 27 may be mounted on the operating sash and contact the outer component 17 of the fixed frame assembly 12 in the closed position of the window.

Accordingly, the claims are to be broadly construed to encompass such inversions and modifications which do not vary the operational principles of the device.

Having thus described the invention and illustrated its use, what is claimed as new and is desired to be secured by Letters Patent is:

1. A window construction comprising a fixed frame assembly including spaced parallel horizontal and vertical frame components, each said frame component including an inner frame member adapted to be secured to a building opening, an outer frame member exposed to the exterior environment, and a thermal break interposed between said inner and outer members, an operating frame including upper, lower and side profile members disposed in a generally rectangular configuration, one said profile member being pivotally connected to an inner frame component of said fixed frame assembly, said profile members of said operating frame including at the outermost face thereof an outwardly facing glazing surface, a multiple pane sub-assembly secured to said glazing surface of said operating frame, said sub-assembly including a spaced parallel pair of glass lites having spacer means disposed therebetween and bonded to the opposed interior surfaces of said lites adjacent the margins thereof, said sub-assembly being disposed forwardly of all portions of said operating frame, a first seal member mounted on said glazing surface of said operating frame and engaging the inner surface of the innermost of said lites about a continuous contact area inwardly spaced from the marginal edges thereof, said inner surface, first seal member and glazing surface defining together a laterally outwardly open perimetal channel portion accessible in a direction parallel to said panes, said channel being substantially completely filled with a quantity of silicone engaging opposed portions of said lite and said glazing surface, said outer frame member of said fixed frame including a laterally directed perimetal flange portion, flexible seal means interposed between said flange portion and the outer face of said outer glass lite in the closed position of said operating frame to define a substantially continuous seal area adjacent the margins of said lite.

2. A window construction in accordance with claim 1 and including a resilient, deformable seal member interposed between said outer members of said fixed frame and said glazing sub-assembly, thereby to form in said closed position of said operable frame a closed perimetal chamber surrounding said pane sub-assembly, said chamber being isolated by said deformable seal member from said operating frame.

3. A window assembly in accordance with claim 2 wherein said deformable seal member is mounted on said outer members of said fixed frame and extends toward said operating frame.

4. A device in accordance with claim 3 wherein said pane sub-assembly includes a polymeric shield member surrounding the edge portion of said lites, said deformable seal member including a root portion engaging said movable frame and an extended portion engaging said shield member in said closed position of said operable frame.

5. Apparatus in accordance with claim 1 wherein said flexible seal means are secured to said flange portion.

6. A window construction comprising a fixed frame assembly including inner and outer, generally rectangular frame portions separated by a thermal break section, an operating frame pivotally secured to said inner frame portion of said fixed assembly, said operating frame being generally rectangular, the outermost portion of said operating frame defining a glazing surface, a pane sub-assembly mounted on said glazing surface and including two spaced parallel glass lites, all portions of said pane sub-assembly being disposed in a plane located outwardly of a plane tangent to the outermost surfaces of said operating frame, a first seal member mounted on said glazing surface of said operating frame and engaging the inner surface of the innermost of said lites about a continuous contact area inwardly spaced from the periphery thereof, said pane, first seal member and glazing surface defining together a laterally open, perimetal channel portion all portions of which are accessible in a direction parallel to said pane, said channel being substantially completely filled with a quantity of silicone engaging opposed portions of said glazing surface and lite and structurally bonding said sub-assembly to said operating frame, said outer frame portions including a laterally directed perimetal flange portion, seal means carried by said flange portion, said seal means, in the closed position of said operating frame, bearing against the outer face of said outer lite to define a substantially continuous seal area adjacent the margins of said lite and urge said sub-assembly toward said glazing surface.

7. A window construction in accordance with claim 6 wherein said outer portion of said fixed frame includes a resilient, deformable perimetal seal member extending toward and engaging said operating frame and said sub-assembly, said perimetal seal member being positioned to isolate all portions of said operating frame and inner frame portion from exposure to the exterior.

8. A window construction comprising, in combination, a fixed frame assembly adapted to be mounted in a building opening and including generally rectangular inner and outer frame components separated by a thermal break, a generally rectangular operating sash assembly including an operating frame pivotally connected to said inner frame component, said sash assembly including a pane sub-assembly having inner and outer parallel spaced glass lites mounted on said operating frame, portions of said pane sub-assembly projecting outwardly of all portions of a plane tangent to the outermost surfaces of said operating frame, an outer flexible seal member interposed between and engaging the outermost surface of said outermost lite adjacent the margins thereof and said outer frame component of said fixed frame assembly in the closed position of said window, an inner flexible seal member extending between said outer frame component and portions of said sash assembly outward of said plane in said closed position of said window, the spaced bounded by said inner and outer seal members defining an essentially sealed chamber, no portions of said operating frame or said inner frame component of said fixed frame assembly forming a boundary of said chamber.

9. A window assembly in accordance with claim 8 wherein said inner seal member includes first portions engaging portions of said operating frame outside said chamber and other portions engaging said sash assembly inside said chamber.

10. A window assembly in accordance with claim 9 wherein said outer seal member is mounted on a portion of said outer frame component outwardly lapping said outer lite.

11. Apparatus in accordance with claim 10 wherein said inner seal assembly is mounted on said outer frame component and engages against a portion of said pane subassembly.

12. Apparatus in accordance with claim 10 wherein said outer seal member includes an inwardly directed leg and said inner seal assembly includes portions engaging said leg.

13. A window construction comprising a fixed frame assembly including spaced parallel horizontal and vertical frame components, each said frame component including an inner frame member adapted to be secured to a building opening, an outer frame member exposed to the exterior environment, and a thermal break interposed between said inner and outer members, an operating frame including upper, lower and side profile members disposed in a generally rectangular configuration, one said profile member being pivotally connected to an inner frame component of said fixed frame assembly, said profile members of said operating frame including at the outermost face thereof an outwardly facing glazing surface, a multiple pane sub-assembly secured to said glazing surface of said operating frame, said sub-assembly including a spaced parallel pair of glass lites having spacer means disposed therebetween and bonded to the opposed interior surfaces of said lites adjacent the margins thereof, said sub-assembly being disposed forwardly of all portions of said operating frame, a first seal member mounted on said glazing surface of said operating frame and engaging the inner surface of the innermost of said lites about a continuous contact area inwardly spaced from the marginal edges thereof, said inner surface, first seal member and glazing surface defining together a laterally outwardly open perimetal channel portion accessible in a direction parallel to said panes, said channel being substantially completely filled with a quantity of silicone engaging opposed portions of said lite and said glazing surface, said outer frame member of said fixed frame including a laterally directed perimetal flange portion, flexible seal means interposed between said flange portion and the outer face of said outer glass lite in the closed position of said operating frame to define a substantially continuous seal area adjacent the margins of said lite, a resilient, deformable seal member interposed between said outer members of said fixed frame and said operable frame, thereby to form in said closed position of said operable frame a closed perimetal chamber surrounding said pane sub-assembly, said chamber being isolated by said deformable seal member from said operating frame, said deformable seal including a root portion engaging said movable frame and a portion displaced from said root portion engaging marginal portions of said pane sub-assembly.

14. A window assembly in accordance with claim 13 wherein said deformable seal divides said chamber into two sub-chambers bounded, respectively, by said deformable seal, pane sub-assembly and outer frame portion on the one hand and said movable frame, flexible seal and pane sub-assembly on the other hand.

15. A window construction comprising a fixed frame assembly including inner and outer, generally rectangular frame portions separated by a thermal break section, an operating frame pivotally secured to said inner frame portion of said fixed assembly, said operating frame being generally rectangular, the outermost portion of said operating frame defining a glazing surface, a pane sub-assembly mounted on said glazing surface and including two spaced parallel glass lites, all portions of said glazing sub-assembly being disposed in a plane located outwardly of a plane tangent to the outermost surfaces of said operating frame, a first seal member mounted on said glazing surface of said operating frame and engaging the inner surface of the innermost of said lites about a continuous contact area inwardly spaced from the periphery thereof, said pane, first seal member and glazing surface defining together a laterally open, perimetal channel portion all portions of which are accessible in a direction parallel to said pane, said channel being substantially completely filled with a quantity of silicone engaging opposed portions of said glazing surface and lite and structurally bonding said sub-assembly to said operating frame, a perimetal polymeric shield member on said operating frame surrounding side marginal edges of said pane sub-assembly, said outer frame portions including a laterally directed perimetal flange portion, seal means carried by said flange portion, said seal means, in the closed position of said operating frame, bearing against the outer face of said outer lite to define a substantially continuous seal area adjacent the margins of said lite and urge said sub-assembly toward said glazing surface, the combination including a resilient deformable perimetal seal member on said outer frame portion, portions of said deformable seal member engaging said shield member and defining therewith a continuous circumferential first contact area external of all portions of said operating frame.

16. A construction in accordance with claim 15 wherein said deformable seal member includes in addition portions engaging said operating frame along a second continuous circumferential contact area located inwardly of said first contact area.

17. A window construction in accordance with claim 16 wherein said shield member includes a laterally directed fin portion, and said first contact area is defined between said fin portion and said deformable seal member.

18. A window construction comprising, in combination, a fixed frame assembly adapted to be mounted in a building opening and including generally rectangular inner and outer frame components separated by a thermal break, a generally rectangular operating sash assembly including an operating frame pivotally connected to said inner frame component, said sash assembly including a pane sub-assembly having inner and outer parallel spaced glass lites mounted on said operating frame, portions of said pane sub-assembly projecting outwardly of all portions of a plane tangent to the outermost surfaces of said operating frame, an insulating shield member on said sash assembly surrounding the side margins of said lites, an outer flexible seal member interposed between and engaging the outermost surface of said outermost lite adjacent the margins thereof and said outer frame component of said fixed frame assembly in the closed position of said window, an inner flexible seal member mounted on said outer frame component, said inner seal member including first portions engaging said operating frame outside said chamber and other portions engaging said shield inside said chamber in said closed position of said window, the space bounded by said inner and outer seal members defining an essentially sealed chamber, no portions of said operating frame intruding into said chamber.

19. A window construction comprising a fixed frame assembly including inner and outer, generally rectangular frame portions separated by a thermal break section, an operating frame pivotally secured to said inner frame portion of said fixed assembly, said operating frame being generally rectangular, the outermost portion of said operating frame defining a glazing surface, a pane sub-assembly mounted on said glazing surface and including two spaced parallel glass lites, all portions of said pane sub-assembly being disposed in a plane located outwardly of a plane tangent to the outermost surface of said operating frame, a first seal member mounted on said glazing surface of said operating frame and engaging the inner surface of the innermost of said lites about a continuous contact area inwardly spaced from the periphery thereof, said pane, first seal member and glazing surface defining together a laterally open, perimetal channel portion all portions of which are accessible in a direction parallel to said pane, said channel being substantially completely filled with a quantity of silicone engaging opposed portions of said glazing surface and lite and structurally bonding said sub-assembly to said operating frame, said outer frame portions including a laterally directed perimetal flange portion, seal means carried by said flange portion, said seal means, in the closed position of said operating frame, bearing against the outer face of said outer lite to define a substantially continuous seal area adjacent the margins of said lite and urge said sub-assembly toward said glazing surface, a resilient deformable perimetal seal member on said outer portion of said fixed frame extending toward and engaging said operating frame at a first position and said sub-assembly at a second position outwardly displaced from said first position, thereby to isolate all portions of said operating frame from exposure to the exterior and to define within the space between said outer frame portions and said operating frame a pair of discrete perimetal chambers to opposite sides of said deformable perimetal seal.

20. A window construction comprising a fixed frame assembly including spaced parallel horizontal and vertical frame components, each said frame component including an inner frame member adapted to be secured to a building opening, an outer frame member exposed to the exterior environment, and a thermal break interposed between said inner and outer members, an operating frame including upper, lower and side profile members disposed in a generally rectangular configuration, one said profile member being pivotally connected to an inner frame component of said fixed frame assembly, said profile members of said operating frame including at the outermost face thereof an outwardly facing glazing surface, a multiple pane sub-assembly secured to said glazing surface of said operating frame, said sub-assembly including a spaced parallel pair of glass lites having spacer means disposed therebetween and bonded to the opposed interior surfaces of said lites adjacent the margins thereof, said sub-assembly being disposed forwardly of all portions of said operating frame, a first seal member mounted on said glazing surface of said operating frame and engaging the inner surface of the innermost of said lites about a continuous contact area inwardly spaced from the marginal edges thereof, said inner surface, first seal member and glazing surface defining together a laterally outwardly open perimetal channel portion accessible in a direction parallel to said panes, said channel being substantially completely filled with a quantity of silicone engaging opposed portions of said lite and said glazing surface, said outer frame member of said fixed frame including a laterally directed perimetal flange portion, flexible seal means interposed between said flange portion and the outer face of said outer glass lite in the closed position of said operating frame to define a substantially continuous seal area adjacent the margins of said lite, a resilient deformable seal member interposed between said outer members of said fixed frame and said operable frame, thereby to form in said closed position of said operable frame a closed perimetal chamber surrounding said pane sub-assembly, said chamber being isolated by said deformable member from said operating frame, said pane sub-assembly including a polymeric shield member surrounding the edge portion of said lites, said deformable seal member including a root portion engaging said movable frame and an extended portion engaging said shield member in said closed position of said operable frame.

* * * * *